United States Patent [19]

Fimbell, III

[11] Patent Number: 5,060,711

[45] Date of Patent: Oct. 29, 1991

[54] MODULAR DOOR PANEL STRUCTURE AND METHOD OF ASSEMBLY AND DOOR ASSEMBLED THEREFROM

[76] Inventor: Edward Fimbell, III, R. D. #1, Box 114, Lambertville-Rocktown Rd., Lambertville, N.J. 08530

[21] Appl. No.: 269,400

[22] Filed: Nov. 10, 1988

[51] Int. Cl.[5] ..... E06B 3/48

[52] U.S. Cl. ..... 160/229.1; 160/236

[58] Field of Search ..... 160/236, 201, 229.1; 52/455, 458

[56] References Cited

U.S. PATENT DOCUMENTS

| | | | |
|---|---|---|---|
| 2,931,435 | 4/1960 | Neiseander | 52/455 X |
| 2,993,572 | 7/1961 | Rich | 160/229.1 X |
| 3,063,105 | 11/1962 | Hollands | 160/229.1 |
| 3,198,242 | 8/1965 | Crosswell | 160/229.1 X |
| 3,703,061 | 11/1972 | Holland et al. | 52/455 X |
| 4,008,745 | 2/1977 | Bailey | 160/236 X |
| 4,794,972 | 1/1989 | Hormann | 160/236 |

FOREIGN PATENT DOCUMENTS

| | | | |
|---|---|---|---|
| 1051271 | 3/1979 | Canada | 160/236 |
| 494676 | 5/1954 | Italy | 160/236 |

*Primary Examiner*—Blair M. Johnson

*Attorney, Agent, or Firm*—Cushman, Darby & Cushman

[57] ABSTRACT

A modular door panel structure includes extruded metal upper and lower horizontally aligned rail members maintained in a generally parallel spaced apart relationship by vertically aligned end stiles and one or more intermediate mullions to define an open structural framework. A multi-component plastic-clad insulation pane is assembled into the framework with locking strips that fix each pane in position within the framework to provide a dimensionally stable, light-weight modular panel having a maintenance free exterior surface and a very high thermal insulation value relative to the traditional door. The modules are assembled by mating the end stiles and the intermediate mullions to one of the upper or lower rails, inserting the plastic-clad insulation panes between the upstanding stiles and mullions, and mating the other of the rails to the end stiles and mullions. Locking strips are wedged between the insulation panes and their adjacent rails, stiles, and/or mullions to fix the insulation panes in position relative the various frame members. The present invention advantageously provides a modular structure and method of assembly for a door in which a light-weight, low-maintenance door panel having superior insulation characteristics is provided in a time- and labor-efficient manner.

8 Claims, 7 Drawing Sheets

MODULAR DOOR PANEL STRUCTURE AND METHOD OF ASSEMBLY AND DOOR ASSEMBLED THEREFROM

CROSS REFERENCE TO RELATED APPLICATIONS

The subject matter of the present application is related to that disclosed in applicant's co-pending and commonly owned U.S. patent application Ser. No. 07/185,874, filed Apr. 25, 1988 and entitled "Design for a Modular Door Panel or Similar Article."

BACKGROUND OF THE INVENTION

The present invention relates to the fabrication of doors of the type commonly used for garages and, more particularly, to the fabrication of a modular door panel having improved mechanical and thermal performance characteristics and which can be assembled into a completed door in a time- and labor-efficient manner.

The traditional garage door is assembled from a series of panels, typically four, that are hinged together on their rearward side in an adjoining relationship and mounted in laterally positioned tracks to allow the door to be raised to an open position or lowered to a closed position. The typical panel is formed from a wooden frame defined by spaced horizontally aligned footer and header members connected with vertically aligned end members and one or more intermediate members. Wooden panes are inserted between the various frame members to define a complete panel. In general, the traditional garage door performs its intended function; however, the wood components require periodic maintenance to protect the door from weathering, and the door does not provide a high level of thermal insulation. Since the frame is fabricated from wood structural members, a considerable amount of labor- and time-intensive joining and fitting is required to manufacture each panel.

Efforts have been made to improve door performance by cladding the weather-exposed surfaces of the door with a vinyl sheet material to minimize the requirement to periodically paint or otherwise treat the weather-exposed surfaces of the door. In general, the use of vinyl and other plastic claddings or coatings adds to the labor and material costs of door fabrication and only provides a marginal increase in thermal insulation performance.

SUMMARY OF THE INVENTION

In view of the above, it is an object of the present invention, among others, to provide a modular door panel structure that can be quickly and efficient manufactured.

It is another object of the present invention to provide a modular door panel structure that has both improved maintenance performance and superior thermal insulation performance.

It is still another object of the present invention to provide a modular door panel structure and method of assembly in which each modular panel can be assembled in a time and cost efficient manner.

In view of these objects, and others, the present invention provides a modular door panel structure defined by metal upper and lower horizontally aligned rail members maintained in a spaced-apart, parallel relationship by vertically aligned end stiles and one or more intermediate mullions to define an open structural framework. A multi-component plastic-clad insulation pane is assembled into the framework with locking strips that fix each pane in position within the framework to provide a dimensionally stable and light-weight modular panel having a maintenance-free exterior surface and a high thermal insulation value relative to the traditional door.

Each module is assembled by mating the end stiles and intermediate mullions to one of the upper or lower rails, inserting the plastic-clad insulation panes between the stiles and mullions, and mating the other of the rails to the end stiles and mullions. Thereafter, the insulation panes are fixed in position relative to the end stiles, the mullions, and the upper and lower rails by wedging one or more locking strips between the insulation panes and the various frame members.

An articulated door is assembled from a plurality of modules by attaching conventional roller-type hinges to adjacent rails of two adjoining modules to form a door assembly.

In the preferred embodiment, the upper and lower rails, the end stiles, and the intermediate mullions are formed from extruded aluminium members pre-configured to allowed time-efficient joining of the members. The insulation panes are fabricated from an insulation core of an expanded polymer, typically styrofoam, with a vinyl sheet adhesively secured to both side of the insulation core. If desired, the vinyl sheet on the weather-exposed exterior is a molded, three-dimensional fascia that simulates the traditional wooden door surface. Various of the extruded members include spurs that interengage with a locking strip to secure the insulation panes in place.

The present invention advantageously provides a modular structure and method of assembly for a door in which a light-weight, low-maintenance door panel having superior insulation characteristics is provided in a time- and labor-efficient manner.

Other objects and further scope of applicability of the present invention will become apparent from the detailed description to follow, taken in conjunction with the accompanying drawings, in which like parts are designated by like reference characters.

DESCRIPTION OF THE PREFERRED EMBODIMENT

Figure 1:
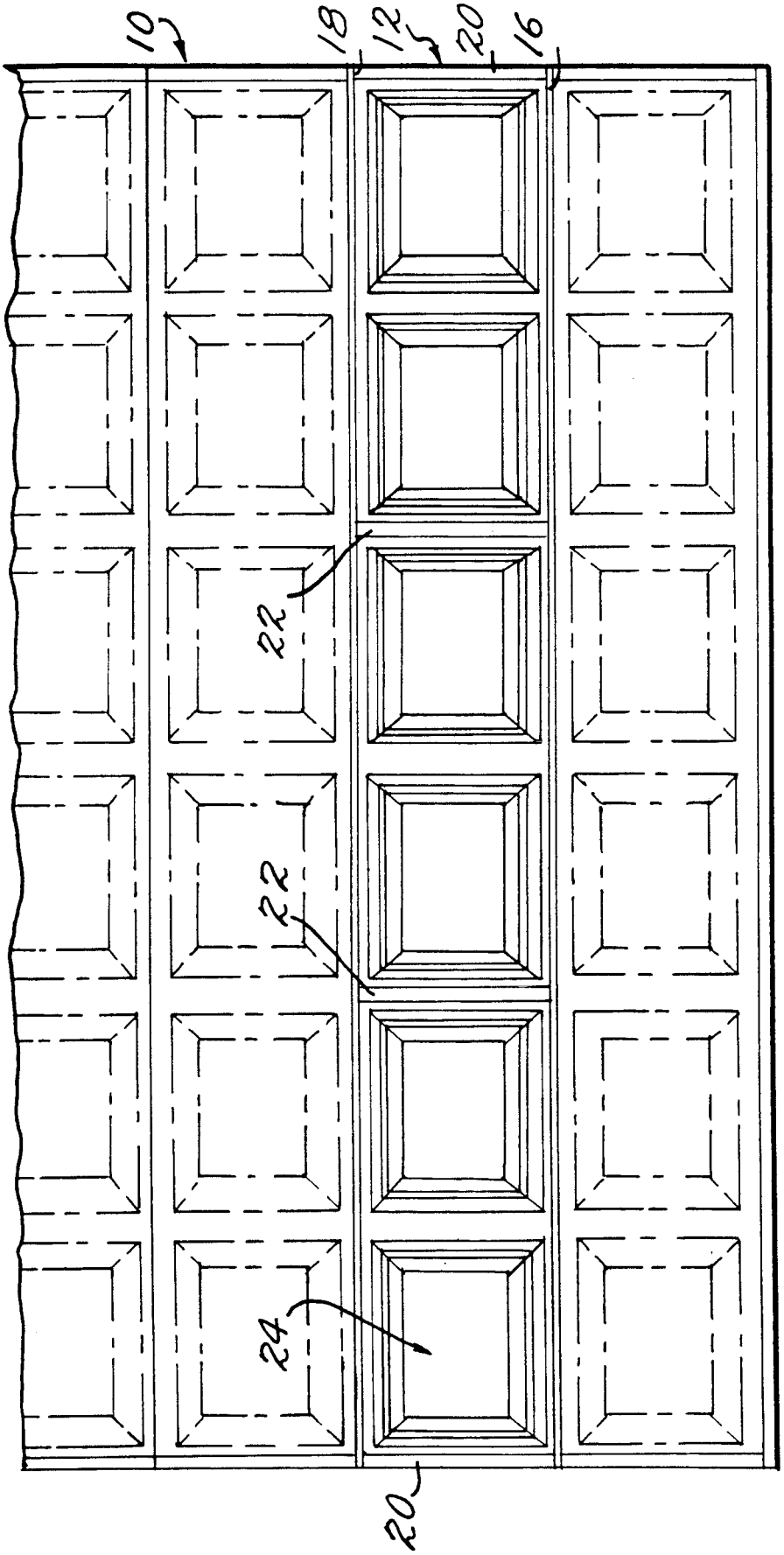
FIG. 1 is a front view of an exemplary garage door in accordance with the present invention and showing one door panel module in solid line illustration.
Figure 2:
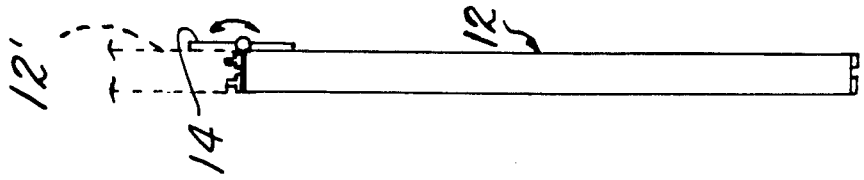
FIG. 2 is a side view of the door panel module of FIG. 1 and additionally illustrates the manner by which a door panel module (solid line illustration) is hinged to an adjacent module (dotted line illustration) to provide an articulated door structure.
Figure 3:
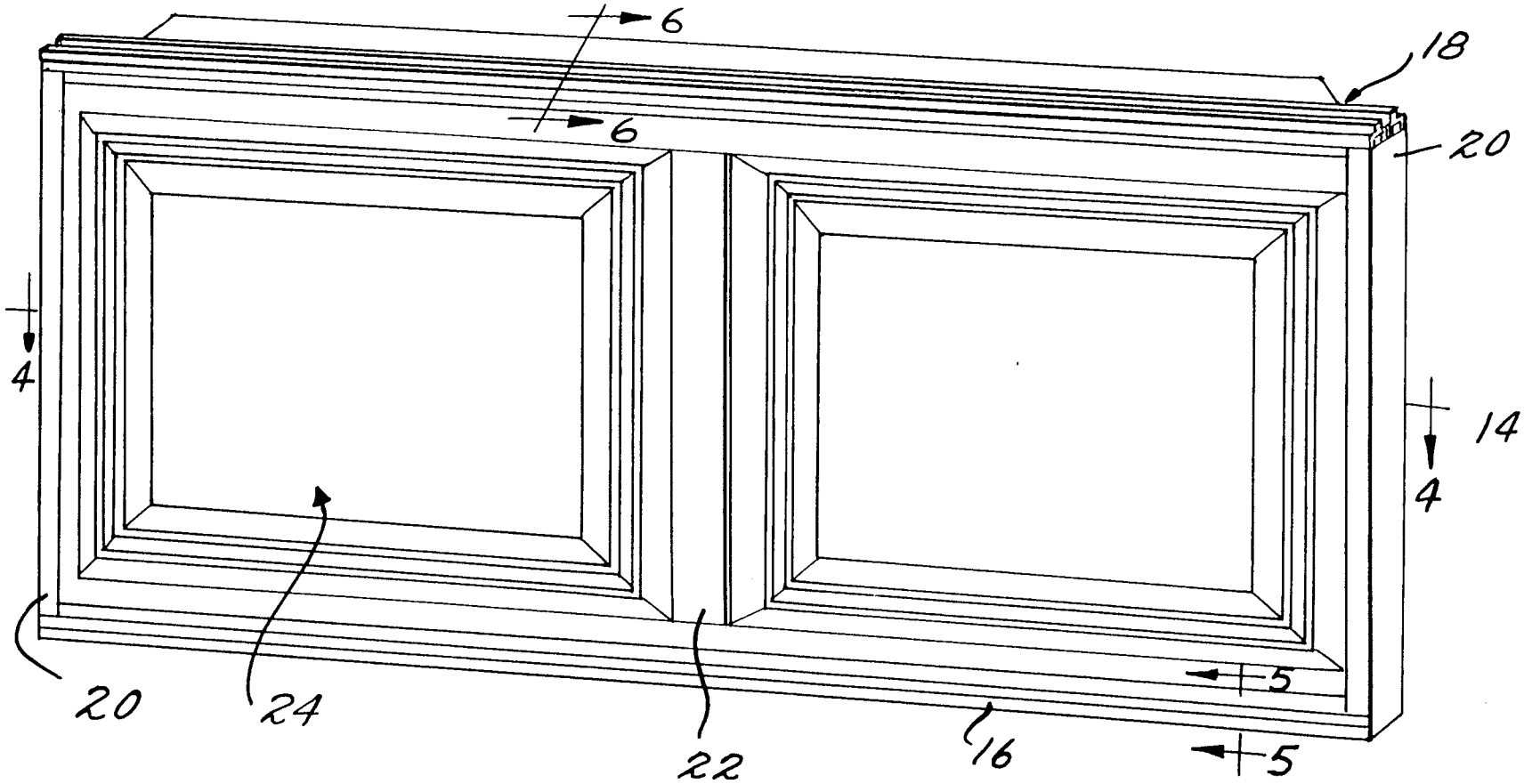
FIG. 3 is a perspective view of a representative door panel module in accordance with the present invention.
Figure 4:
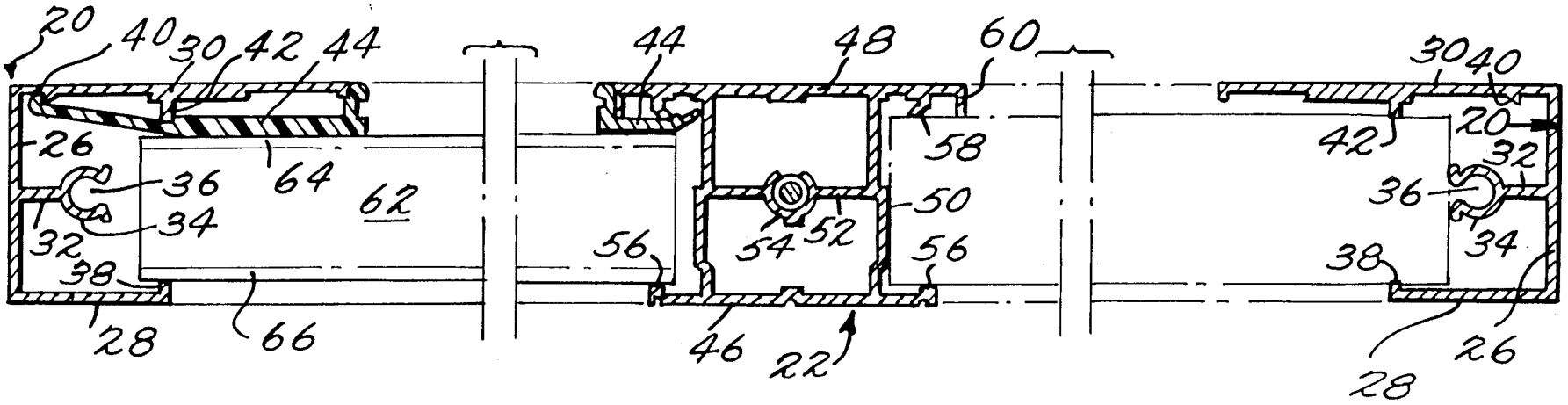
FIG. 4 is a top cross sectional view of the door panel module of FIG. 3 taken along line 4—4 of FIG. 3.

An articulated garage door in accordance with the present invention is shown in front view in FIG. 1 and designated generally therein by the reference character 10. As shown, the door 10 is assembled from a series of horizontally aligned door panel modules 12 that are connected at their adjacent upper and lower edges to form the assembled door 10. As shown in FIG. 2, a door panel module 12 (solid line illustration) is connected to its adjacent door panel module 12' by a hinge 14 in the conventional manner to provide an articulated structure. As shown in FIGS. 1, 2, and 4, each door panel module 12 includes a framework defined by a lower rail 16, an upper rail 18 that is spaced apart from the lower rail 16, an end stile 20 on the opposite ends of the door panel module 12 separating the lower rail 16 from the an upper rail 18, and one or more mullions 22 located between the end stiles 20. The number of mullions 22 employed is generally a function of the overall width of the door panel module 12; in the case of the door panel module 12 shown in FIG. 1, two intermediate mullions 22 are used, and, in the representative door panel module 12 shown in FIG. 3, a single mullion 22 is used. The framework defines openings (not shown in the FIGURES) that accept insert composite panes 24, described more fully below.

As shown in the cross-sectional view of FIG. 4, each end stile 20 includes an end wall 26 that is connected to a front wall 28 and a rear wall 30 to define a three-sided open channel. An intermediate wall section 32 extends inwardly of the end wall 26 and includes a semi-circular structure 34 and defines a groove 36 that accommodates a threaded fastener to connected either the lower rail 16 or the an upper rail 18 to the end stile 20, as explained below. The front wall 28 includes an inwardly facing ridge 38 preferably extending the length of the end stile 20, and the rear wall 30 includes a locking spur 40 and a stop ridge 42, both of which preferably extend along the length of the end stile 20. As shown in FIG. 4, a lock strip 44 interengages the interior surface of the rear wall 30, as explained more fully below. The center mullion 22 includes a front wall 46, a rear wall 48, and side walls 50 that define a hollow, box-like tubular structure. An intermediate wall 52 extends between the side walls 50 in a generally parallel relationship with the front and rear walls 46 and 48 and includes a semi-circular structure 54 that defines a groove (unnumbered) for accepting a threaded fastener. The front wall 46 extends laterally outward of the side walls 50 and includes inwardly facing ridges 56, and the rear wall 48 extends laterally outward of the side walls 50 and includes inwardly facing locking spurs 58 and stop ridges 60. A lock strip 44 interengages the locking spur 58 and the stop ridge 60 to maintain a composite sub-panel or pane 24 in place, as explained below. In the preferred embodiment, each end stile 20 and mullion 22 is formed from extruded aluminium, although other molded or extruded materials are suitable.

Each composite pane 24 includes a molded internal core 62, preferably of closed cell styrofoam, a flat vinyl backing sheet 64, and a molded decorative fascia sheet 66. As explained below in relationship to FIGS. 10 and 11, the fascia sheet 66 is molded in the form of embossed panels that simulate the appearance of a conventional wooden door, for example. The core 62 provides substantial thermal insulation performance for the door panel module 12 and the fascia sheet 66 provides a low maintenance, weather resistant exterior surface.

Figure 5:
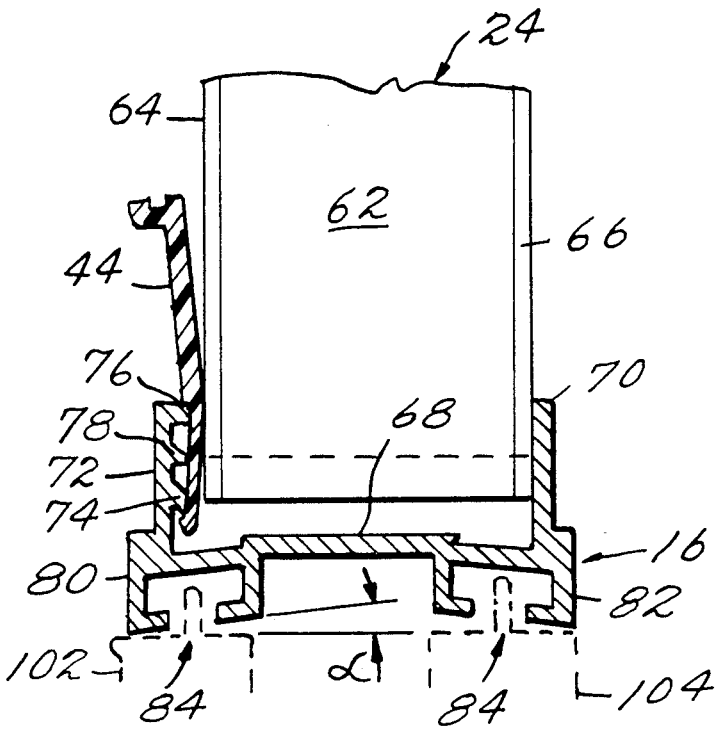
FIG. 5 is side view, in cross section, of a lower rail of the door panel module of FIG. 3, taken along line 5—5 of FIG. 3 and showing the manner by which the lower rail (solid line illustration) interengages with the upper rail (dotted line illustration) of an adjacent door panel module.

As shown in FIG. 5, the lower rail 16 includes a bottom wall 68, an upstanding front wall 70, and an upstanding rear wall 72 to define a three-wall open channel. The rear wall 72 includes an inwardly facing-/locking spur 74, a stop ridge 76, and an intermediate ridge 78 that each preferably extend the length of the lower rail 16. A lock strip 44 interengages the locking spur 74, the stop ridge 76 and the intermediate ridge 78 to maintain the composite pane 24 in place against the inward surface of the front wall 70. Two downwardly extending trackways 80 and 82 are formed on the under side of the bottom wall 68 and are each defined by depending L-shaped sections (unnumbered) that provide a groove 84 that extends the length of the lower rail 16. The lower ends of the L-shaped sections of the trackways 80 and 82 define oppositely inclined planes that each converge at a selected angle $\alpha$, preferably 5°, relative to the horizontal in FIG. 5. As explained below, the trackways 80 and 82 and their grooves 84 are part of an inter-panel engagement system. The lower rail 16, as in the case of the end stiles 20 and mullions 22, is preferably fabricated from extruded aluminum.

Figure 6:
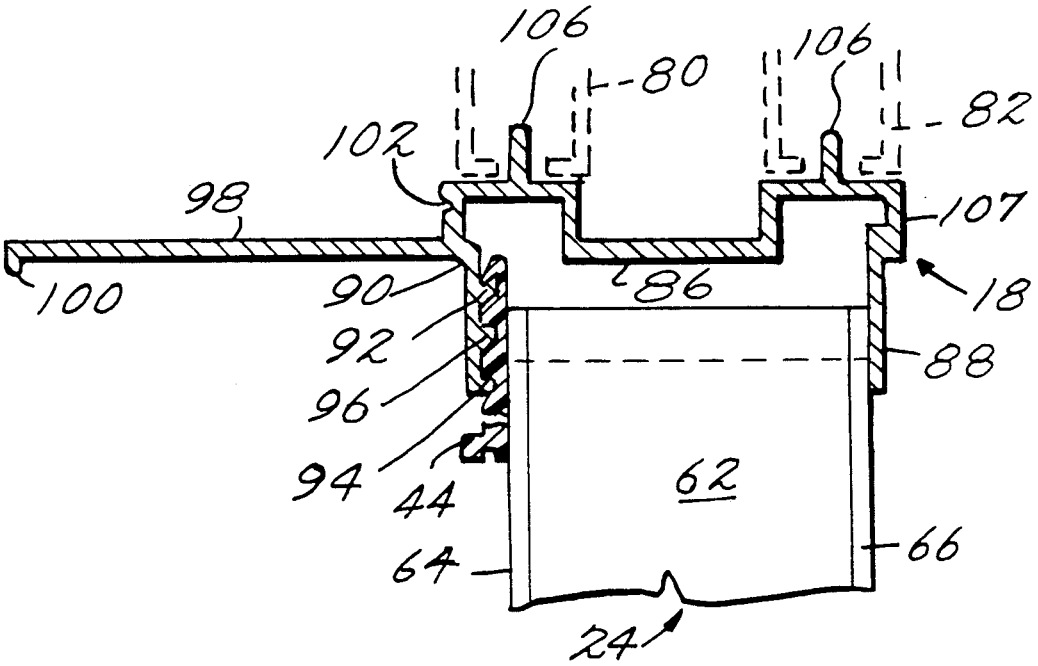
FIG. 6 is side view, in cross section, of an upper rail of the door panel module of FIG. 3, taken along line 6—6 of FIG. 3, and showing the manner by which the upper rail (solid line illustration) interengages with the lower rail (dotted line illustration) of an adjacent door panel module.

As shown in FIG. 6, the upper rail 18 includes a top wall 86, a downwardly extending front wall 88, and a downwardly extending rear wall 90 to define a three-wall open channel. The rear wall 90 includes an inwardly facing locking spur 92, a stop ridge 94, and an intermediate ridge 96 that each preferably extend the length of the upper rail 18. A lock strip 44 interengages the locking spur 92, the stop ridge 94, and the intermediate ridge 96 to maintain the composite pane 24 in place against the inner surface of the front wall 88. A reinforcing fin 98 extends laterally of the rear wall 90 and terminates in a distal bead 100 to provide a measure of torsional and longitudinal stiffening to the upper rail 18. Two pedestals 102 and 104 extend upwardly from the top wall 86 with each pedestal including upwardly and longitudinally extending tabs 106. As shown in dotted line illustration in both FIGS. 5 and 6, the tabs 106 are spaced apart from one another in a parallel relationship to extend into and be received by the grooves 84 of the trackways 80 and 82 formed on the under side of the lower rail 16 to define an inter-panel engagement system that functions as a wind and rain barrier between the exterior and interior side of the assembled door 10. The upper rail 18, as in the case of the end stiles 20, the mullions 22, and the lower rail 16, is preferably fabricated from extruded aluminum.

Figure 7:
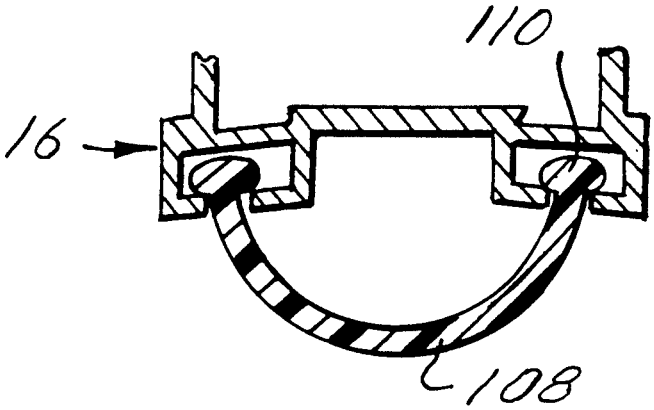
FIG. 7 is an end view, in cross-section, illustrating the manner by which a sealing strip is mounted to the lower rail of the lowermost door panel module.

As shown in FIG. 7, the lower rail 16 on the bottommost door panel module 12 also can function to accept a ground-engaging elastomeric seal 108 formed as a semi-circular member with enlarged strips 110 that are forced into the grooves 84 to maintain the seal 108 in place.

Figure 8:
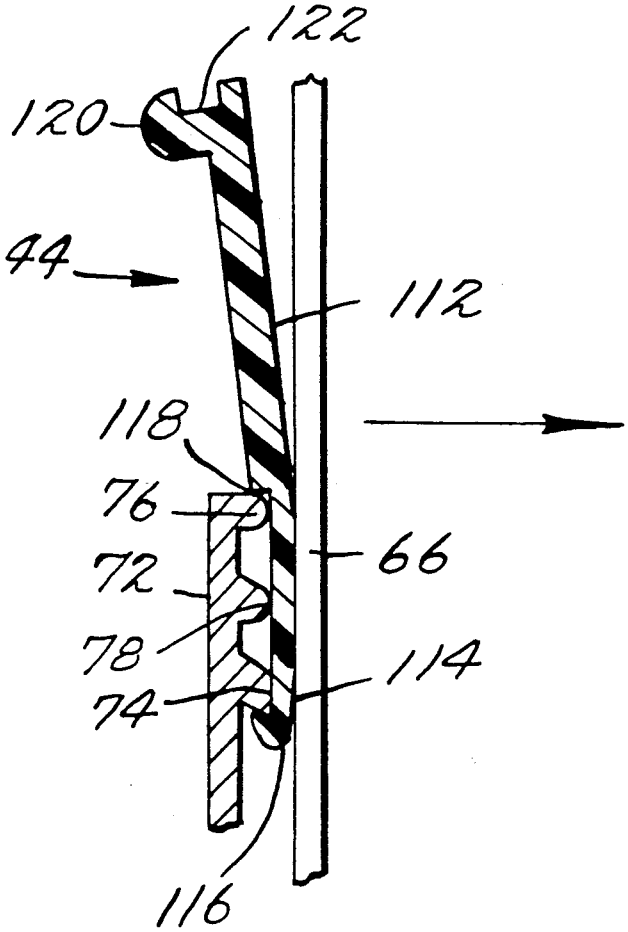
FIG. 8 is side view, in cross section of a portion of a rail of the door panel module of FIG. 3 showing the manner by which the a locking strip interengages with cooperating spurs.

The structure and function of the lock strip 44 is shown in the detail of FIG. 8, and, as shown, the lock strip 44 includes a body portion 112 having a forward reduced-thickness extension 114 defined between a rounded, hook-like nose 116 at the remote end and a shoulder 118. A laterally extending bead 120 is formed at the opposite end of the lock strip 44 and includes a notch 122 designed to accept the end of a tool, such as a screwdriver, to push the lock strip 44 into its assembled position. The lock strip 44 is designed to be pushed between the rear wall of a structural member, for example, the rear wall 72 of the lower rail 16 in FIG. 7, with the rounded nose 116 forcing the back sheet 64 of the composite pane 24 away from the rear wall 72 so that the locking spur 74 engages the bight portion of the hook-like nose 116 and the stop ridge 76 abuts the shoulder 118 to secure the lock strip 44 in place. The intermediate ridge 78 serves to assist in guiding the reduced-thickness extension 114 to the locking spur 74 during installation. As represented by the arrow F in FIG. 8, the lock strip 44 forces the composite pane 24 in the direction of the front wall 70 to frictionally locate and secure the composite pane 24 in place. The frictional engagement is such that the composite pane 24, while reasonably secure, can expand and contract in response to temperature changes, as represented by the dotted lines in FIGS. 5 and 6. The lock strip 44 is preferably fabricated from a resilient extruded plastic, such a vinyl.

Figure 9:
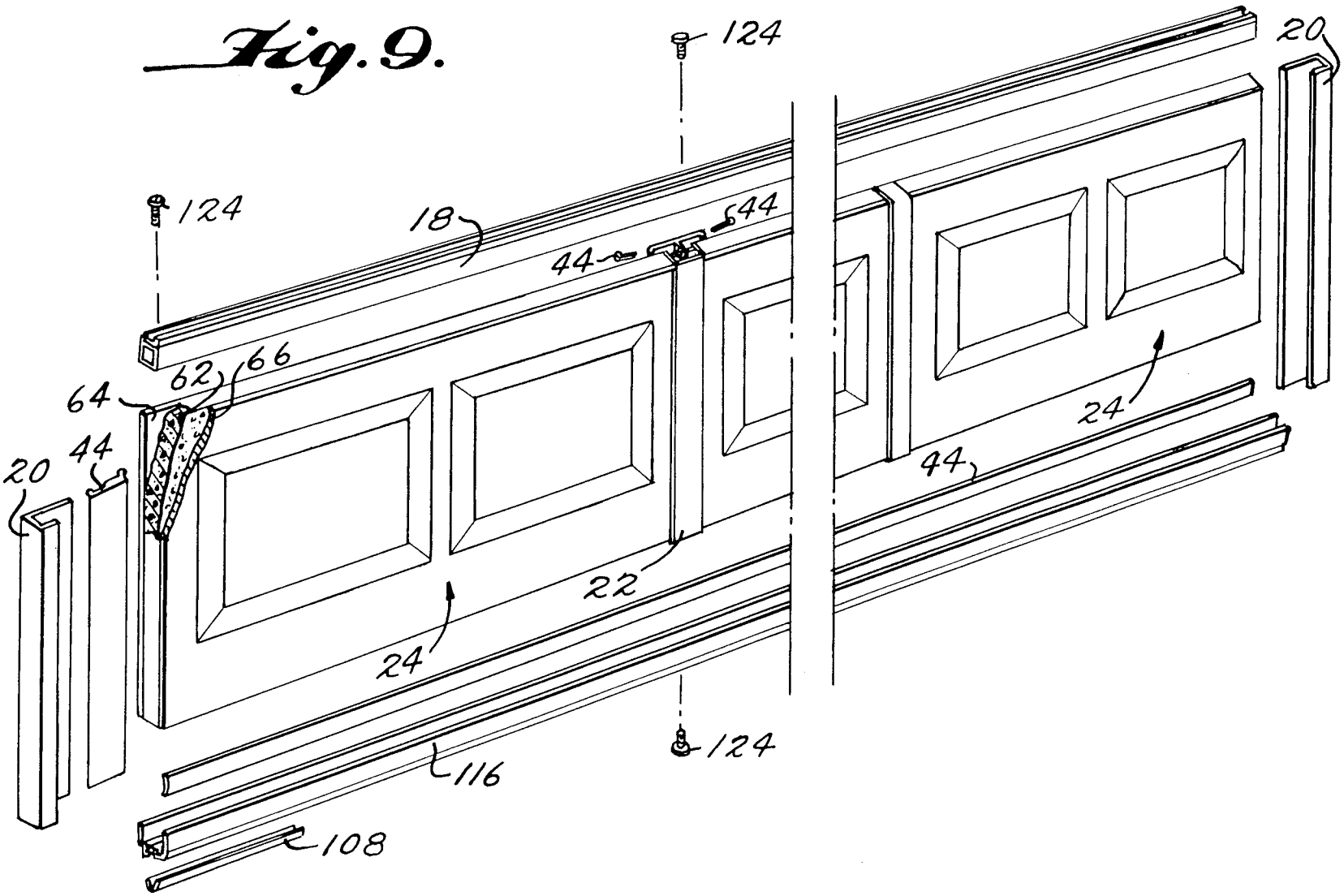
FIG. 9 is an exploded perspective of a modular door panel illustrating the relationship of the various parts.

The various above-described components of the door panel module 12 are preferably assembled in the manner shown in the exploded perspective of FIG. 9. The end stiles 20 and one or more mullions 22, depending upon the width of the door panel module 12, are assembled to the lower rail 16 in an upstanding relationship using threaded fasteners, as represented at 124. The pre-fabricated composite panes 24 are then slide into position between the various front and rear walls of the end stiles 20, the mullion(s) 22, and the lower rail 16. Thereafter, an upper rail 18 is placed over the assembly and secured in its assembled position with suitable threaded fasteners 124. As explained above in relationship to FIG. 4, each end stile 20 includes a semi-circular structure 36 and each mullion 22 includes a semi-circular structure 54 for accepting threaded fasteners 124. After the structural members that define the framework and the composite panes 24 are assembled, the lock strips 44 are forced into position between the back sheet 64 of the composite pane 24 and the corresponding rear wall of the structural member to securely lock the composite pane 24 in place. As can be appreciated by those skilled in the art, the assembly does not require a high degree of manual skill or specialized tools and can be accomplished in a time and cost efficient manner.

Figure 10:
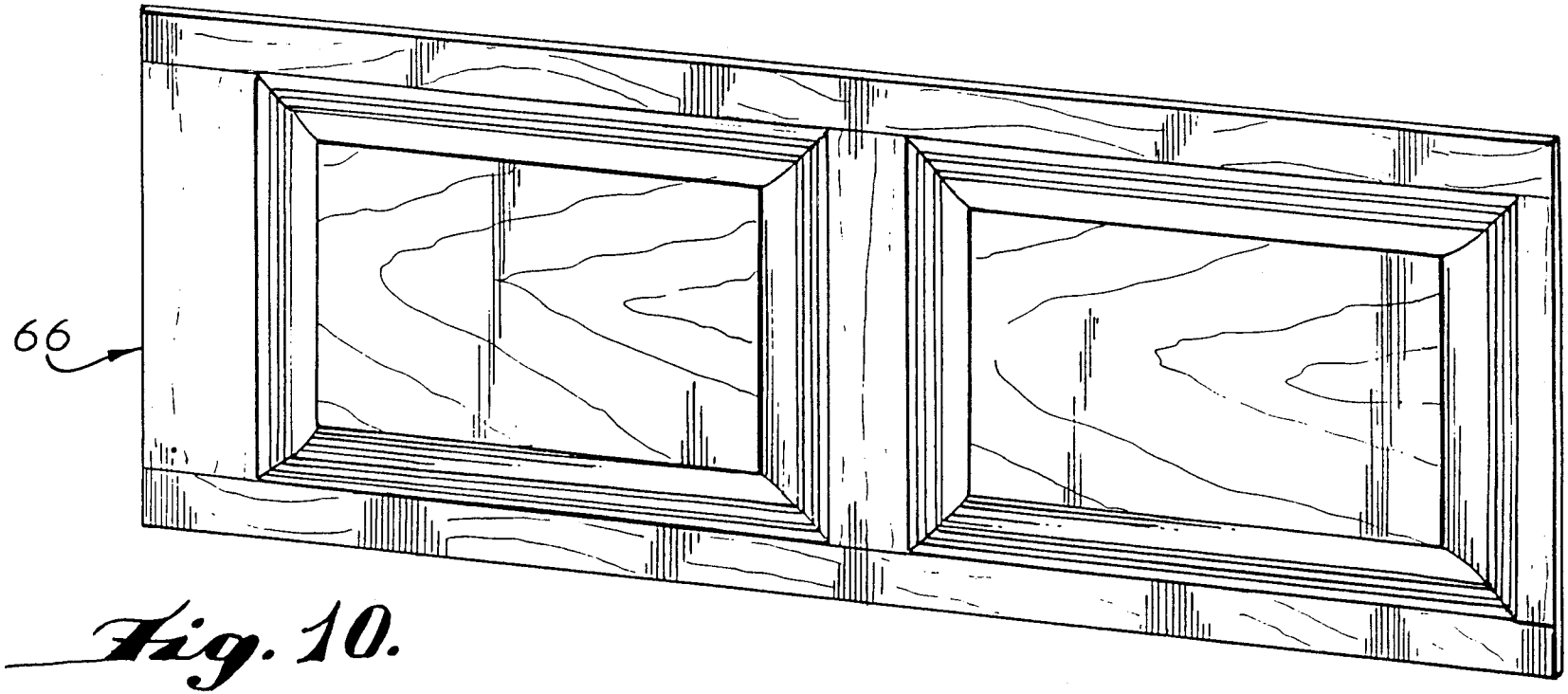
FIG. 10 is a perspective view of a molded fascia used in assembling the door panel module.
Figure 11:
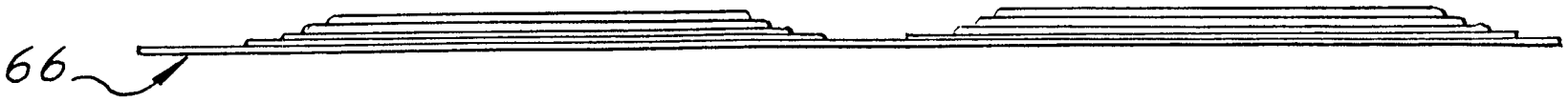
FIG. 11 is a top view of the molded fascia of FIG. 10.

The composite panes 24, as described above, are fabricated from a molded styrofoam core 62, a vinyl back sheet 64, and a vinyl vacuum-molded fascia sheet 66. As shown in FIGS. 10 and 11, the fascia sheet 66 is preferably molded to incorporate a wood grain and imitate the appearance, for example, of a traditional wooden door. Other fascia sheet 66 designs are disclosed in applicant's co-ending and commonly owned U.S. patent application Ser. No. 07/185,874, filed Apr. 25, 1988 and entitled "Design for a Modular Door Panel or Similar Article," the disclosure of which is incorporated herein by reference.

The present invention advantageously provides a modular door panel structure, method of assembly, and door having superior thermal insulation characteristic and lower maintenance cost and which can be fabricated in a time and labor efficient manner.

As will be apparent to those skilled in the art, various changes and modifications may be made to the illustrated modular door panel structure and method of assembly and door assembled therefrom of the present invention without departing from the spirit and scope of the invention as determined in the appended claims and their legal equivalent.

What is claimed is:

1. An articulated door assembly, comprising:

at least first and second modular door panels, each of said door panels including a framework defined by first and second parallel, spaced-apart and longitudinally extending rail members and first and second stile members connecting said first and second rail members, each of said rail members having respective opposed first and second wall sections, and a pane member mounted between said wall sections of said members;

at lest one locking strip positioned between said pane member and at least one wall to positionally retain said pane in place;

engagement means defined between said locking strip and said at least one wall section to retain said locking strip in place, said engagement means comprising a locking spur and a hook-like means interengaged with one another to retain said locking strip in place and a stop ridge formed on said at least one wall section to control the engaged position of said locking strip;

hinge means for connecting said first rail member of one of said modular door panels to the second rail member of the other of said modular door panels;

a first tab-and-slot engagement interface between said first rail members and said second rail members of adjacent panels, said first tab-and-slot engagement interface including a longitudinally extending tab formed on a one of said rail members and the other of said rail members having a longitudinally extending slot formed therein for receiving said longitudinally extending tab; and a second tab-and-slot engagement interface adjacent said first tab-and-slot engagement interface and including a longitudinally extending tab formed on a one of said rail members and the other slot formed therein for receiving said longitudinally extending tab of said second tab-and-slot engagement interface.

2. The articulated door assembly of claim 1, further comprising:

at least one mullion member connecting said first and second rail members, said mullion member having opposed first and second wall sections;

said pane member mounted between said wall sections of said first and second rail members, one of said stile members, and said mullion member; and another pane member mounted between said wall sections of said first and second rail members, the other of said stile members, and said mullion member.

3. An articulated door assembly, comprising:

at least first and second modular door panels, each of said door panels including a framework defined by first and second parallel, spaced-apart and longitudinally extending rail members and first and second stile members connecting said first and second rail members, each of said rail members having respective opposed first and second wall sections, and a pane member mounted between said wall sections of said members;

at least one locking strip positioned between said pane member and said at least one wall section to positionally retain said pane in place;

engagement means defined between said locking strip and said at least one wall section to retain said locking strip in place, said engagement means comprising a locking spur formed on said wall and extending in the direction of said pane and a hook means formed on the locking strip and in engagement with said locking spur to retain said locking strip in place;

a stop ridge formed on said at least one wall section to control the engaged position of said locking strip; and hinge means for connecting said first rail member of one of said modular door panels to the second rail member of the other of said modular door panels.

4. The articulated door assembly of claim 3, further comprising:

at least one mullion member connecting said first and second rail members, said mullion member having opposed first and second wall sections;

said pane member mounted between said wall sections of said first and second rail members, one of said stile members, and said mullion member; and another pane member mounted between said wall sections of said first and second rail members, the other of said stile members, and said mullion member.

5. The articulated door assembly of claim 3, further comprising another ridge formed on said one wall section intermediate said stop ridge and said locking spur.

6. The articulated door assembly of claim 1, wherein said locking spur is formed on said at least one wall and said hook-like means is formed on said locking strip.

7. The articulated door assembly of claim 1, further comprising another ridge formed on said at least one wall section intermediate said stop ridge and said locking spur.

8. The articulated door assembly of claim 6, further comprising a stop ridge formed on said at least one wall section to control the engaged position of said locking strip.

* * * * *